US011219277B1

(12) United States Patent
Ben-Arie

(10) Patent No.: US 11,219,277 B1
(45) Date of Patent: Jan. 11, 2022

(54) FAST BUTTON ATTACHMENT BY RESILIENT FLAPS TRAPPING

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

(21) Appl. No.: 17/206,135

(22) Filed: Mar. 19, 2021

(51) Int. Cl.
*A44B 1/04* (2006.01)
*A44B 1/28* (2006.01)

(52) U.S. Cl.
CPC . *A44B 1/04* (2013.01); *A44B 1/28* (2013.01)

(58) Field of Classification Search
CPC ..... A44B 1/04; A44B 1/28
See application file for complete search history.

(56) References Cited

U.S. PATENT DOCUMENTS 1,981,813 A * 11/1934 Schuster ..... A44B 1/28 24/108
2,671,255 A * 3/1954 Kember ..... A44B 1/34 24/114.4
3,389,439 A * 6/1968 Papazian ..... A44B 1/28 24/114.05
3,623,192 A * 11/1971 Papazian ..... A44B 1/34 24/114.4
3,725,980 A * 4/1973 Burgio ..... A44B 1/34 24/108
3,982,013 A 9/1976 Katsuda
4,033,012 A 7/1977 Kramer
4,512,063 A 4/1985 Fukuroi
4,683,621 A * 8/1987 Watanabe ..... A44B 1/08 24/95
4,723,421 A * 2/1988 Nitsche ..... F16B 37/0842 63/12
4,751,780 A 6/1988 Trolltsch et al.
4,875,257 A * 10/1989 Anderson ..... A44B 1/06 24/114.9
4,928,362 A 5/1990 Collas
5,428,872 A * 7/1995 Papazian ..... A44B 1/28 24/103
5,575,043 A 11/1996 Candotti
5,933,929 A * 8/1999 Kawakami ..... A44B 17/0035 24/681
5,940,940 A 8/1999 Tanikoshi
5,975,398 A 11/1999 Evans
8,522,404 B2 9/2013 Matei
8,938,861 B1 1/2015 McLendon
9,820,520 B2 11/2017 Bolen
(Continued)

*Primary Examiner* — David M Upchurch

(57) ABSTRACT

A button assembly configured for fast button attachment on a garment cloth.
The assembly comprises a button with attached multiplicity of resilient flaps, and a pole connecting a hemisphere (or a cone) to a disk. Fast button attachment on the garment cloth is achieved by placing the disk with the attached hemisphere (or a cone) facing an inner side of the garment cloth while placing the button outside opposite the hemisphere (or cone). Next, pushing outwards the hemisphere (cone) pierces the cloth by the hemispherical (or the conical) dome and inserts it into the button. The entering dome temporarily bends and afterwards releases the flaps, which end up resting diagonally on the pole above the hemisphere (or cone). The flaps then trap the hemisphere (or the cone) inside by preventing it from exiting the button. whereby, completing button's attachment by permanently attaching it to the garment cloth.

10 Claims, 11 Drawing Sheets

(56) References Cited

U.S. PATENT DOCUMENTS

| | | | | |
|---|---|---|---|---|
| 10,004,299 | B2 | 6/2018 | Maussen | |
| 2001/0005924 | A1* | 7/2001 | Watanabe | A44B 1/28 24/94 |
| 2005/0121479 | A1* | 6/2005 | de Macedo | G06K 19/07749 223/1 |
| 2005/0188510 | A1 | 9/2005 | Retamal | |
| 2010/0236029 | A1* | 9/2010 | Mattei | A44B 1/28 24/114.4 |
| 2014/0007382 | A1* | 1/2014 | Makki | A44B 1/42 24/94 |

* cited by examiner

FAST BUTTON ATTACHMENT BY RESILIENT FLAPS TRAPPING

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

TECHNICAL FIELD

The present invention relates to Buttons Attachment to Garment Cloths.

PRIOR ART

We have found several inventions of button assemblies that were configured for button attachment but all of them are dissimilar to our invention both in their structures and in their principles of operation. Most, if not all of these attachment assemblies rely on some sort of metallic pedestal crimping to attach it to the garment cloth. In U.S. Pat. No. 4,033,012 (Jul. 5, 1977) to Kramer et al. teaches a metallic button held by a metallic pedestal that is stapled to the garment cloth by a four legged metallic staple that is crimped to hold the pedestal. In U.S. Pat. No. 8,522,404 (Sep. 3, 2013) Matei teaches a button which can be tilted because it is attached to an elongated metallic shaft with ball attached at one end. The ball is housed in a ball bearing cavity included in the mounting base attached to the garment. In US 2005/0188510 (Sep. 1, 2005) Retamal teaches a button attached to an elongated serrated metal shaft which fits into a serrated metal nut attached to the garment. In U.S. Pat. No. 4,751,780 (Feb. 25, 1986) Fukuroi teaches a metal button which is attached to a mounting base by a crimped metal nail. In U.S. Pat. No. 4,512,063 (Apr. 23, 1985) Fukuroi teaches a metal button attachment to base by a metal rivet. In U.S. Pat. No. 5,575,043 (Nov. 19, 1996) Candotti also teaches a metal button attachment to base by a metal rivet. In U.S. Pat. No. 4,928,362 (May 29, 1990) Collas proposes to mount a metallic button on a metallic shank which is connected to a disk beneath the garment cloth. In U.S. Pat. No. 5,940,940 (Aug. 24, 1999) Tanikoshi teaches a button mounting by crimping a metal tubular rivet. In U.S. Pat. No. 5,975,398 (Nov. 2, 1999) Evans proposed attaching buttons to clothing by H shaped plastic studs which are inserted through the button holes into the clothing. In U.S. Pat. No. 9,820,520 (Nov. 21, 2017) Bolen teaches an attachment system with two parts one part attaches to the clothing side and the other part attaches to the button side and both parts are then coupled by a magnetic twist-lock mechanism. In U.S. Ser. No. 10/004,299 (Jun. 26, 2018) Maussen Teaches a tapered trapezoidal shape buttons which are connected to fabrics using sewing. In U.S. Pat. No. 3,982,013 (Jul. 1, 1975) Gould teaches a button attachment using a rivet with long serrated shaft that protrudes from the clothing and is attached to a button with fitting aperture. In U.S. Pat. No. 8,938,861 (Jan. 27, 2015) McLendon teaches a removably attachable button using a pair of U-shaped flexible pins with small hooks at their ends, which are inserted through the clothing and through the button holes.

All the above inventions are entirely dissimilar to our invention.

BRIEF SUMMARY OF THE INVENTION

I have several goals in inventing and developing the Button Assembly of which some feasible embodiments are illustrated in FIGS. 1-13. The goals are:

1. To develop a Button Assembly which facilitates fast button attachment on a garment cloth without any need for sewing.
2. To adapt suitable button assembly components for fast manual attachment without needing of additional tools or machines.
3. To configure a button structure which can be attached swiftly, firmly and permanently to garment cloths.
4. To design an attachment structure (i.e. a connective structure) for the button which can withstand without breaking strong pulling forces when applied to the button.
5. To develop a button assembly which could be manufactured very cheaply in mass production from common elastic materials such as plastics.
6. To design a button assembly approach which enables creation of a large variety of colors and shapes of button appearances.
7. To develop an attachment by trapping mechanism that exploits the resiliency of materials such as plastics to trap in the button one end of an attachment structure while the second end of the attachment structure is connected to the garment cloth. Whereby permanently tying the button to the garment cloth.

In order to achieve some of the objectives listed above, our mechanism for button attachment to garment cloth adopts the operational principle of mechanical trapping where the action of trapping is initiated by bending a set of resilient gating flaps (i.e. a multiplicity of flaps—as in the Claims) which reside inside the button and later activating the trapping mechanism by releasing the multiplicity of bent flaps. The resilient gating flaps are initially bent by an intrusion of a foreign element (i.e. a hemisphere or a cone on top of a pole) into the button's trapping inner space while pushing and bending inwards the resilient multiplicity of flaps system. Next, the trapping mechanism is triggered shut by releasing the multiplicity of flaps to unbend backwards when the hemisphere (or cone) is pushed further forwards beyond the multiplicity of flaps tips. After trapping, the trapped pole—hemisphere or cone structure serves as a connective structure between the button and the garment.

At the trapped state the attachment structure attaches the button to the garment cloth.

Figure 11:
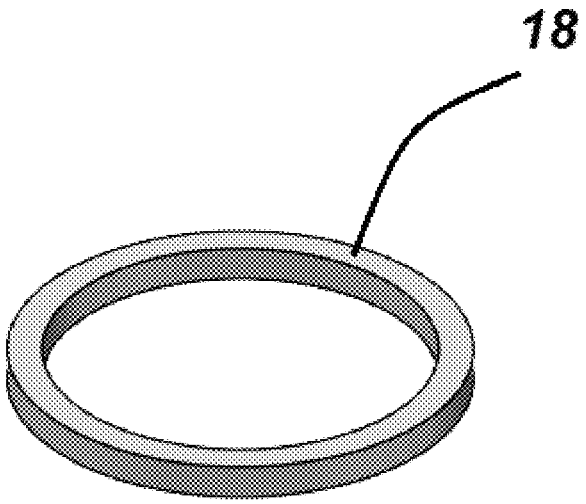

FIG. 11 shows an embodiment of the spacing ring.

DETAILED DESCRIPTION OF THE DRAWINGS

Figure 1:
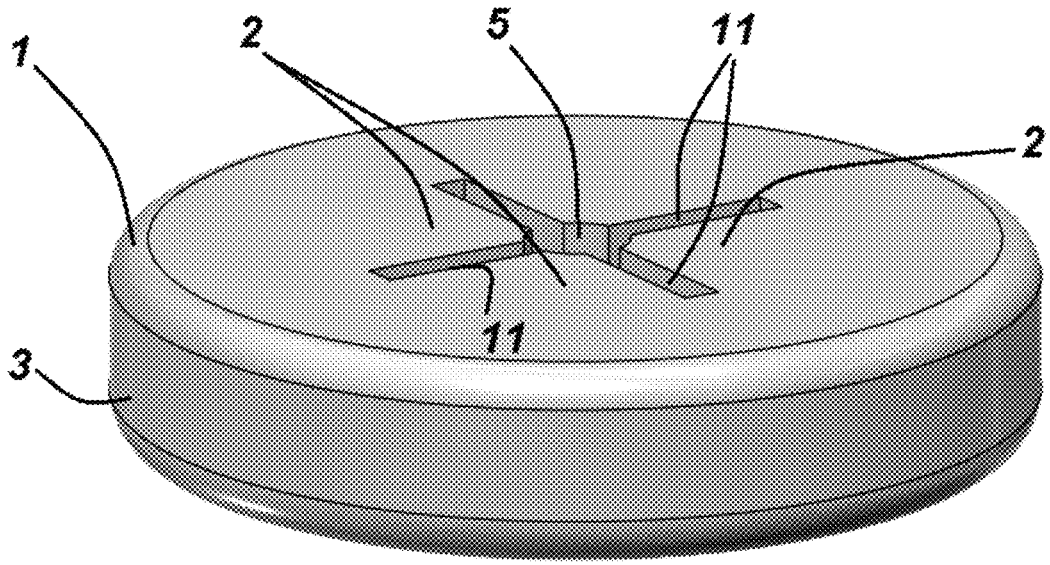
FIG. 1 shows a top view of an embodiment of the button in 3D isometric drawing.

FIG. 1 shows a top view of an embodiment of the button 1 in 3D isometric drawing. The button is structured from a toroid 3 with toroid's upper and lower circular openings. The toroid's upper circular opening is covered by an attached planar disk which is divided by four radial slits 11 centered at the center of the planar disk. The planar disk is made of resilient material. The four slits 11 divide the planar disk into four flaps 2 (which correspond to the multiplicity of flaps in the Claims). The slits are centered at the circular opening 5 drilled at the center of the planar disk.

Figure 2:
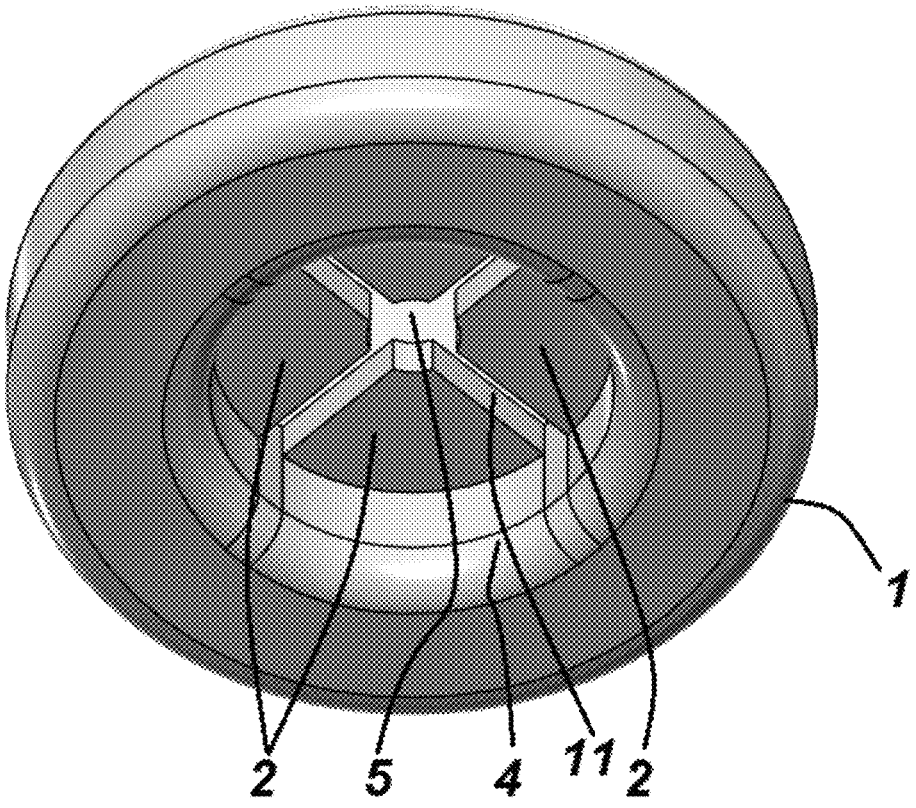
FIG. 2 Depicts in 3D isometric drawing a bottom view of an embodiment of the button in 3D isometric drawing.

FIG. 2 Depicts in 3D isometric drawing a bottom view of an embodiment of the button 1 in 3D isometric drawing. The button 1 is structured from a toroid 3 with toroid's upper and lower circular openings. The toroid's upper circular opening is covered by an attached planar disk which is divided by four radial slits 11 into four flaps 2 (which correspond to the multiplicity of flaps mentioned in the Claims). The slits are centered at the circular opening 5 drilled at the center of the planar disk. The toroid lower circular opening 4 is also shown.

Figure 3:
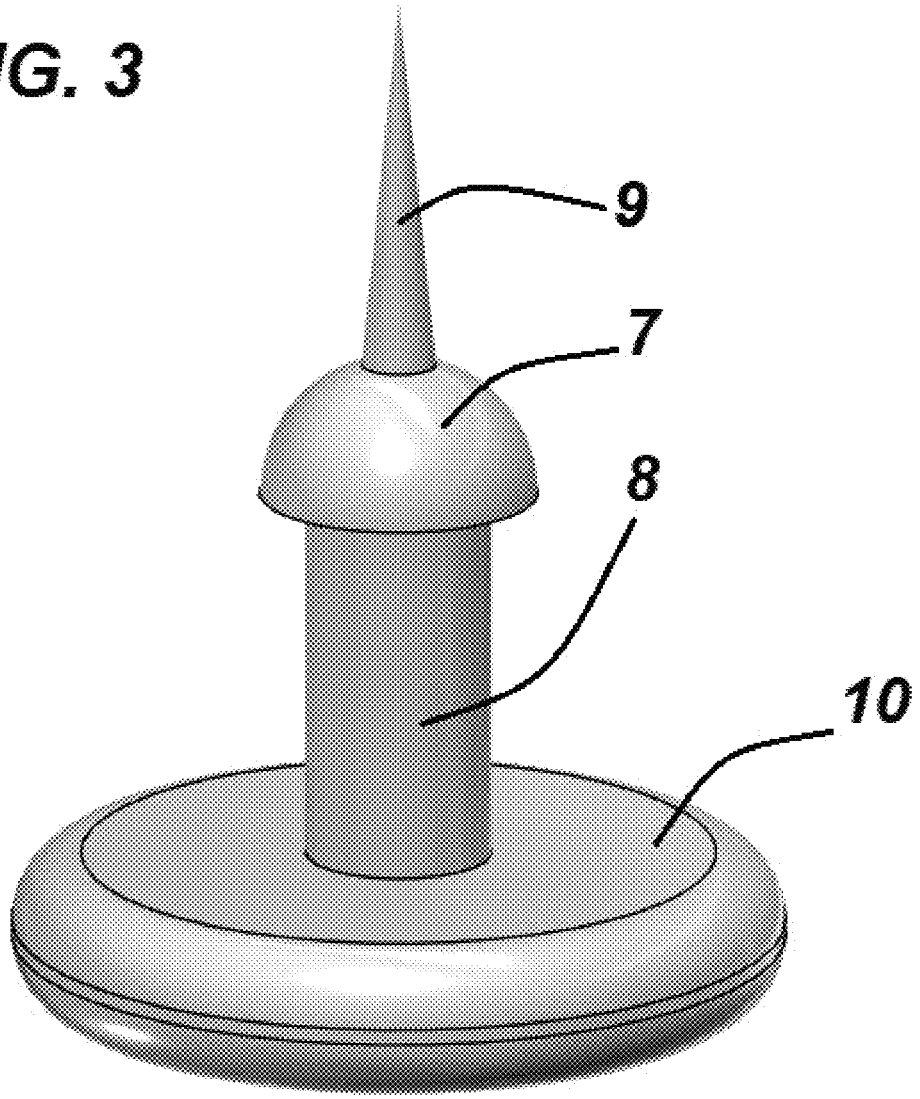
FIG. 3 Illustrates in 3D isometric drawing an embodiment of the attachment structure which includes the hemisphere connected to the pole at the pole's upper end and the retaining disk attached to the lower end of the pole. A piercing cone is attached to the top side of the dome.

FIG. 3 Illustrates in 3D isometric drawing an embodiment of the hemispherical attachment structure which includes the hemisphere 7 connected to the pole 8 at the pole's upper end and the retaining disk 10 which is attached to the lower end of the pole 8. A piercing cone 9 is attached to the top side of the hemisphere's dome 7. The piercing cone 9 is configured to initialize piercing of garment cloths in advance in order to facilitate the garment cloth piercing by the following hemisphere 7. The retaining disk 10 which is placed at the inner side of the garment's cloth, is configured to attach the attachment structure to the garment cloth. The retaining disk 10 does not have to be a circular disk as in FIG. 3 and in fact any flat plate approximately with the same size, could perform the retaining task.

Figure 4:
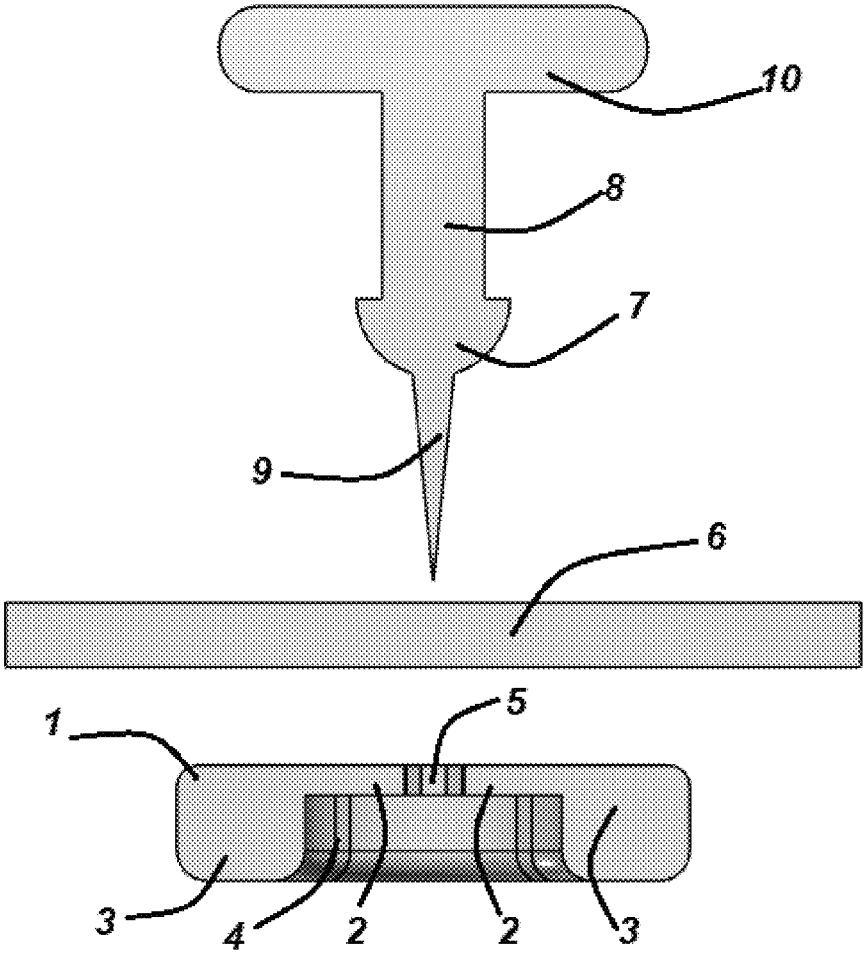
FIG. 4 illustrates a cross section of the attachment structure with the piercing cone pointing downwards and situated above a cross section of a piece of garment cloth. A cross section of the button is depicted underneath the garment cloth and opposite to the piercing cone.

FIG. 4 illustrates a cross section of the hemispherical attachment structure: 7-8-9-10 with the piercing cone 9 pointing downwards and situated above a cross sectional depiction of a piece of garment cloth 6. A cross section of the button 1 is illustrated underneath the garment cloth 6 and opposite to the piercing cone 9.

FIG. 4 actually illustrates the situation of the attachment structure before piercing the garment cloth. A cross sectional view of the button 1 is also shown beneath the garment cloth 6. The Button 1 is structured from a toroid 3 with toroid's upper and lower circular openings. The toroid's upper circular opening is entirely covered by an attached planar disk which is divided by four radial slits 11 into four flaps 2. The slits are centered at the circular opening 5 drilled at the center of the planar disk. The toroid lower circular opening 4 is also shown.

Figure 5:
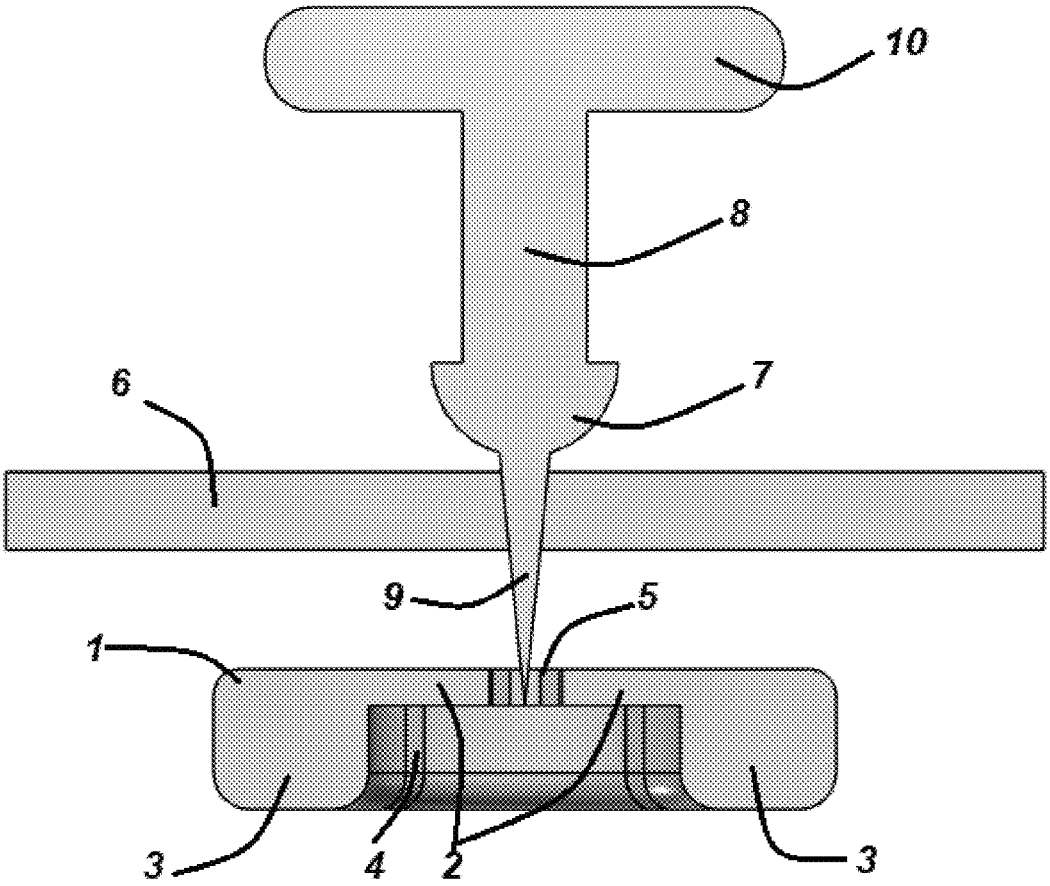
FIG. 5 illustrates a cross section of the attachment structure with the piercing cone pointing downwards while piercing a cross section of a piece of garment cloth. A cross section of the button is depicted underneath the garment cloth and opposite to the piercing cone.

FIG. 5 illustrates a cross section of the hemispherical attachment structure: 7-8-9-10 with the piercing cone 9 pointing downwards and situated at the position where the cone is in the process of piercing of a cross sectional depiction of a piece of garment cloth 6. A cross section of the button 1 is illustrated underneath the garment cloth 6 and opposite to the piercing cone 9. FIG. 5 actually illustrates the situation of the attachment structure while in the process of piercing the garment cloth 6 by the piercing cone 9. A cross sectional view of the button 1 is also shown beneath the garment cloth 6. The Button 1 is structured from a toroid 3 with toroid's upper and lower circular openings. The toroid's upper circular opening is covered by an attached planar disk which is divided by four radial slits 11 into four flaps 2 (which correspond to the multiplicity of flaps mentioned in the Claims). The slits are centered at the circular opening 5 drilled at the planar disk's center. The toroid lower circular opening 4 of the toroid is also shown.

Figure 6:
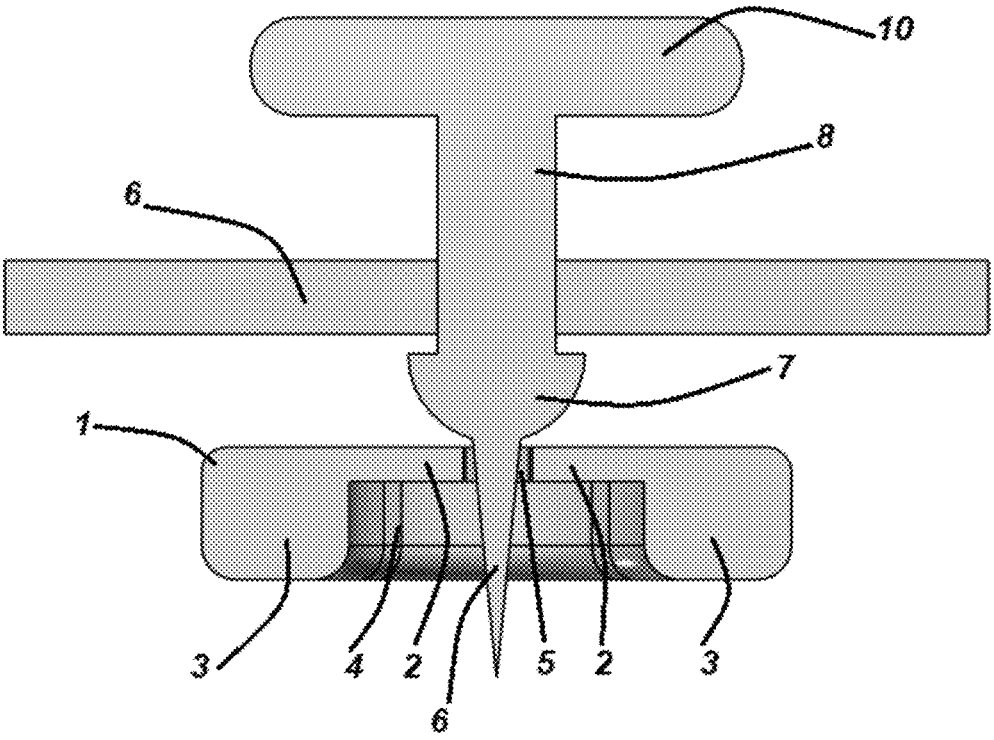
FIG. 6 Depicts a cross section of the attachment structure with the piercing cone pointing downwards while the pole is piercing a cross section of a piece of garment cloth. A cross section of the button is depicted underneath the garment cloth and opposite to the piercing cone.

FIG. 6 illustrates a cross section of the hemispherical attachment structure: 7-8-9-10 with the piercing cone 9 pointing downwards and situated at the position where the pole 8 is in the process of piercing of a cross sectional depiction of a piece of garment cloth 6. A cross section of the button 1 is illustrated underneath the garment cloth 6 and opposite to the piercing cone 9. FIG. 6 actually illustrates the situation of the attachment structure while in the process of piercing the garment cloth 6 by the pole 8. A cross sectional view of the button 1 is also shown beneath the garment cloth 6. The Button 1 is structured from a toroid 3 with toroid's upper and lower circular openings. The toroid's upper circular opening is covered by an attached planar disk which is divided by four radial slits 11 into four flaps 2. The slits 11 are centered at the circular opening 5 drilled at the center of the planar disk. The toroid lower circular opening 4 is also shown.

Figure 7:
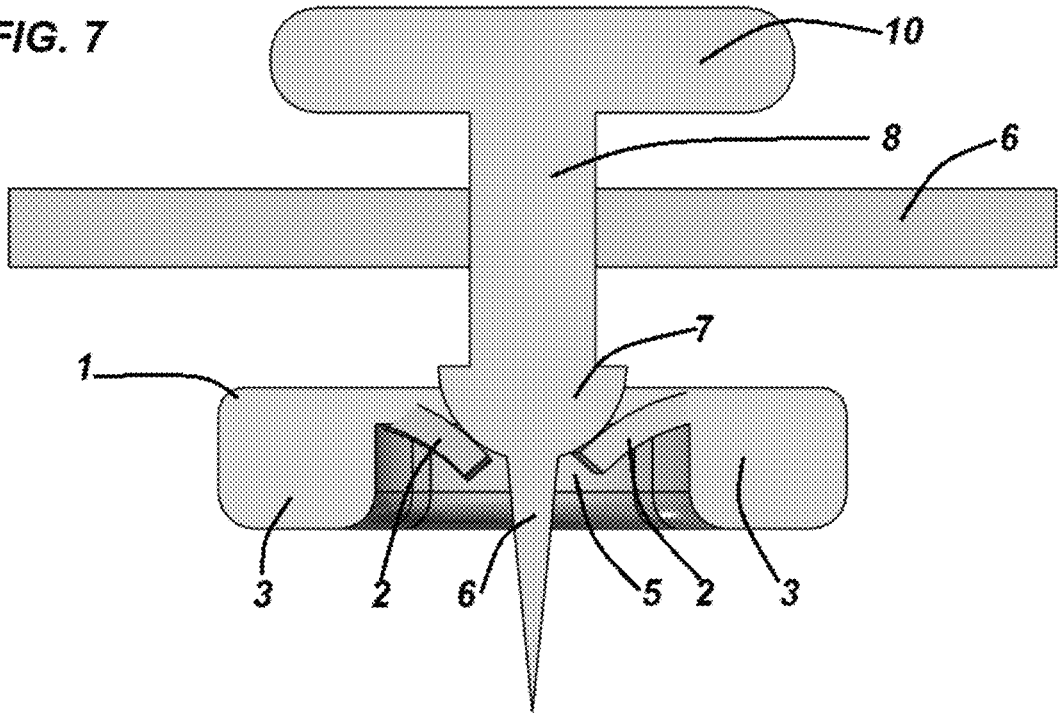
FIG. 7 Shows a cross section of the attachment structure with the piercing cone pointing downwards while the pole is piercing a cross section of a piece of garment cloth. A cross section of the button is depicted underneath the garment cloth while the hemisphere's dome is in the process of pushing and bending downwards the multiplicity of flaps.

FIG. 7 illustrates a cross section of the hemispherical attachment structure: 7-8-9-10 with the piercing cone 9 pointing downwards and situated at the position where the hemispheric dome 7 is in the process of bending down the button multiplicity of flaps 2 while the pole 8 is in the process of piercing of a cross sectional depiction of a piece of garment cloth 6. A cross section of the button 1 is illustrated underneath the garment cloth 6 and opposite to the piercing cone 9. FIG. 7 actually illustrates the situation of the attachment structure when the hemispheric dome 7 is in the process of bending down the button's multiplicity of flaps 2 while the garment cloth 6 is pierced by the pole 8. A cross sectional view of the button 1 is shown beneath the garment cloth 6. The Button 1 is structured from a toroid 3 with toroid's upper and lower circular openings. The toroid's upper circular opening is covered by an attached planar disk which is divided by four radial slits 11 into four flaps 2. The slits 11 are centered at the circular opening 5 drilled at the center of the planar disk. The toroid lower circular opening 4 is also shown.

Figure 8:
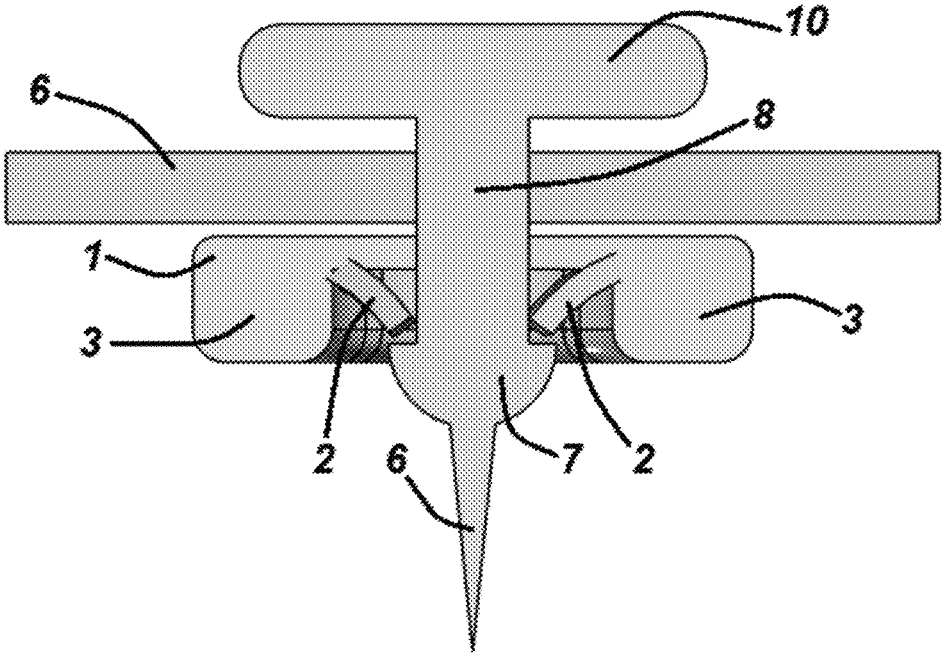
FIG. 8 Shows a cross section of the attachment structure with the piercing cone pointing downwards while the pole is piercing a cross sectional depiction of a piece of garment cloth. A cross section of the button is depicted underneath the garment cloth while the hemisphere's dome already traveled beneath the tips of the multiplicity of flaps that are now released and are now diagonally resting on the pole above the hemisphere. At this position the multiplicity of flaps is preventing upside travel of the hemisphere thus trapping inside the button the hemisphere along with the rest of the attachment structure (i.e. the pole and the retaining disk). At this trapped state the attachment structure attaches the button to the garment cloth.

FIG. 8 illustrates a cross section of the hemispherical attachment structure: 7-8-9-10 with the piercing cone 9 pointing downwards and situated at the position where the hemispheric dome 7 is beyond the process of bending the button's multiplicity of flaps 2 while the pole 8 is in the process of piercing of a cross sectional depiction of a piece of garment cloth 6. At this situation the hemispheric dome 7 has already passed beyond and below the tips of the multiplicity of flaps 2 and the flaps now are un-bended, released and diagonally resting on the pole 8 above the hemisphere. At this position the multiplicity of flaps is preventing the hemisphere from moving upwards thus trapping the hemisphere 7 inside the button 1. A cross section of the button 1 is illustrated underneath the garment cloth 6 and opposite to the piercing cone 9. FIG. 8 actually illustrates the situation of the attachment structure when the hemispheric dome 7 is beyond the process of bending the button flaps 2 while the pole 8 is in the process of piercing of a cross sectional depiction of a piece of garment cloth 6. At this situation the hemispheric dome 7 has already passed beyond and below the tips of the multiplicity of flaps 2 and the multiplicity of flaps now are released, un-bended and diagonally resting on the pole 8 above the hemisphere 7 while trapping the hemisphere beneath them inside the button. At this trapped state the attachment structure completes the attachment of the button to the garment cloth.

A cross sectional view of the button 1 is shown beneath the garment cloth 6. The Button 1 is structured from a toroid 3 with toroid's upper and lower circular openings. The toroid's upper circular opening is covered by an attached planar disk which is divided by four radial slits 11 into four flaps 2. The slits are centered at the circular opening 5 drilled at the center of the planar disk. The toroid lower circular opening 4 is also shown.

Figure 9:
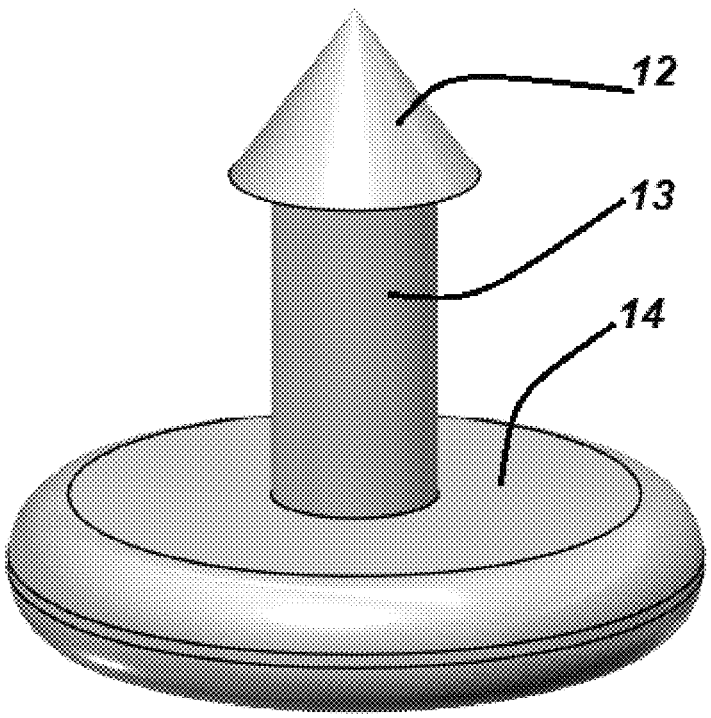
FIG. 9 Illustrates in 3D isometric drawing an embodiment of the conical attachment structure which includes the cone connected to the pole at the pole's upper end and the retaining disk attached to the lower end of the pole.

FIG. 9 Illustrates in 3D isometric drawing an embodiment of the conical attachment structure which includes the cone 12 connected to the pole 13 at the pole's upper end and the retaining disk 14 attached to the lower end of the pole 13.

Figure 10:
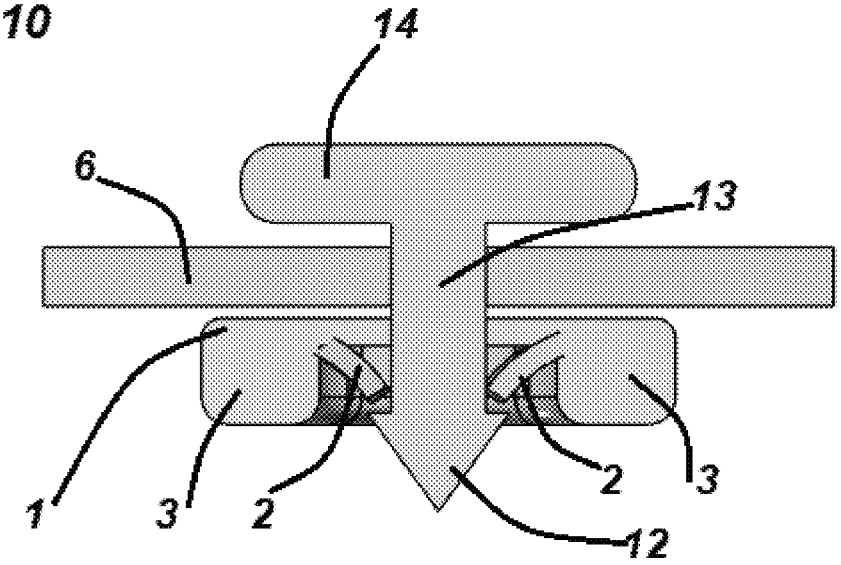
FIG. 10 Shows a cross section an embodiment of the conical attachment structure with the cone pointing downwards while the pole is piercing a cross sectional depiction of a piece of garment cloth. A cross section of the button is depicted underneath the garment cloth while the cone's dome already traveled beyond the tips of the multiplicity of flaps that are now released and are now diagonally resting on the pole above the cone and is preventing upside travel of the hemisphere thus trapping inside the button the hemisphere along with the rest of the attachment structure (i.e. the pole and the retaining disk).

FIG. 10 illustrates a cross section of the conical attachment structure: 12-13-14 with the cone 12 pointing downwards and situated at the position where the conic dome 12 is beyond the process of bending and releasing the button's multiplicity of flaps 2 while the pole 13 is piercing a cross sectional depiction of a piece of garment cloth 6. At this situation the conic dome 7 has already passed beyond and below the tips of the multiplicity of flaps 2 and the flaps now are un-bended, released and diagonally resting on the pole 13 above the cone and preventing the cone from travelling upwards i.e. trapping the cone beneath the multiplicity of flaps. A cross section of the button 1 is illustrated underneath the garment cloth 6 and opposite to the cone 12. FIG. 10 actually illustrates the situation of the attachment structure when the conic dome 12 is beyond the process of bending and releasing the button's multiplicity of flaps 2 while the pole 13 is piercing a cross sectional depiction of a piece of garment cloth 6. At this situation the conic dome 12 has already passed beyond and below the tips of the multiplicity of the flaps 2 and the flaps now are un-bended and diagonally resting on the pole 13 above the cone and preventing the cone from travelling upwards, thus trapping the cone inside the button. At this trapped state the attachment structure completes the attachment of the button to the garment cloth.

A cross sectional view of the button 1 is shown beneath the garment cloth 6. The Button 1 is structured from a toroid 3 with toroid's upper and lower circular openings. The toroid's upper circular opening is covered by an attached planar disk which is divided by four radial slits 11 into four flaps 2. The slits are centered at the circular opening 5 drilled at the center of the planar disk. The lower circular opening 4 of the toroid is also shown.

FIG. 11 Illustrates the spacing ring 18 which is installed on the pole 8 between the garment cloth 6 and the button 1 after completion of the attachment. The spacing ring 18 is configured to facilitate buttoning.

What is claimed is:

1. A button assembly configured for fast button attachment on a garment cloth;

wherein the button assembly comprises:

a button comprising: a toroid and a planar disk;

wherein the toroid includes a toroid upper circular opening and a toroid lower circular opening;

wherein a toroid upper side is attached to the planar disk which is configured to be circular and large enough to cover entirely the toroid upper circular opening;

wherein the planar disk is made of a resilient material and is divided into a multiplicity of flaps by a multiplicity of radial slits which are centered at a planar disk's center;

the button assembly also comprises: an attachment structure which includes a retaining disk, a pole and a hemisphere;

wherein the pole is configured to be cylindrical and to include a pole's top end and a pole's bottom end;

wherein the hemisphere includes a circular upper plane attached below to a hemispherical dome;

wherein the pole's bottom end is perpendicularly attached to a center of the circular upper plane;

wherein the pole's top end is perpendicularly attached to a center of the retaining disk;

when the hemisphere is pushed downwards through the toroid upper circular opening, it is configured to bend and turn downwards the multiplicity of flaps; when the hemisphere is pushed further downwards into a position below the multiplicity of flaps, the multiplicity of flaps are released and are configured to unbend, turning upwards due to their resiliency until the multiplicity of flaps end up diagonally resting on the pole above the circular upper plane of the hemisphere;

when the multiplicity of flaps are diagonally resting on the pole above the circular upper plane of the hemisphere, they are configured to prevent the hemisphere from moving upwards whereby trapping the hemisphere in the button;

the button assembly is configured to be used for fast button attachment on the garment cloth by placing the retaining disk with the attached hemisphere facing an inner side of the garment cloth while placing the button at an outer side of the garment cloth such that the upper toroid circular opening is opposite the hemisphere;

next, pushing outwards the hemisphere from the inner side of the garment cloth is configured to pierce the garment cloth by the hemispherical dome and to insert the hemisphere into the toroid upper circular opening situated at an outer side of the garment cloth opposite the hemispherical dome; inserting the hemisphere through the toroid upper circular opening is configured to bend the multiplicity of flaps and to trap the hemisphere inside the button;

wherein the trapped hemisphere which is situated beneath the multiplicity of flaps which are diagonally resting on the pole above the hemisphere, is configured to prevent detachment and separation of the button from the retaining disk and from the garment cloth;

whereby, completing the attachment of the button by permanently attaching the button to the garment cloth; wherein the button assembly also comprises of a spacer ring which is installed around the pole beneath the garment cloth after piercing the garment cloth; the spacer ring is configured to space the button from the garment cloth in order to facilitate buttoning.

2. The button assembly of claim 1, wherein a radius of the toroid upper circular opening is configured to be larger than the radius of the upper plane of the hemisphere by at least a thickness of the planar disk.

3. The button assembly of claim 1, wherein a radius of a circular cross section of the pole is configured to be smaller than a radius of the circular upper plane of the hemisphere by at least a thickness of the planar disk.

4. The button assembly of claim 1, wherein a piercing cone which is configured to facilitate piercing of the garment cloth when pushed through it, is temporarily attached to a bottom of the hemispherical dome; the piercing cone is configured to be detached and removed after piercing.

5. The button assembly of claim 1, wherein a piercing cone which is configured to facilitate piercing of the garment cloth when pushed through it, is temporarily installed in a cavity drilled at a bottom of the hemispherical dome; the piercing cone is configured to be detached and removed after piercing.

6. A button assembly configured for fast button attachment on a garment cloth;

wherein the button assembly comprises:

a button comprising: a toroid and a planar disk;

wherein the toroid includes a toroid upper circular opening and a toroid lower circular opening;

wherein a toroid upper side is attached to the planar disk which is configured to be circular and large enough to cover entirely the toroid upper circular opening;

wherein the planar disk is made of a resilient material and is divided into a multiplicity of flaps by a multiplicity of radial slits which are centered at a planar disk's center;

the button assembly also comprises: an attachment structure which includes a retaining disk, a pole and a cone;

wherein the pole is configured to be cylindrical and to include a pole's top end and a pole's bottom end;

wherein the cone includes a circular upper plane attached beneath to a conical dome;

wherein the pole's bottom end is perpendicularly attached to a center of the circular upper plane;

wherein the pole's top end is perpendicularly attached to a center of the retaining disk;

when the cone is pushed downwards through the toroid upper circular opening, it is configured to bend downwards the multiplicity of flaps; when the cone is pushed further downwards to a position beneath the multiplicity of flaps, the multiplicity of flaps are released and are configured to unbend turning upwards due to their resiliency until the multiplicity of flaps end up diagonally resting on the pole above the circular upper plane of the cone;

when the multiplicity of flaps are diagonally resting on the pole above the circular upper plane of the cone, they are configured to prevent the cone from moving upwards whereby trapping the cone in the button;

the button assembly is configured to be used for fast button attachment on the garment cloth by placing the retaining disk with the attached cone facing an inner side of the garment cloth while placing the button at an outer side of the garment cloth such that the upper toroid circular opening is opposite the cone;

next, pushing outwards the cone from the inner side of the garment cloth is configured to pierce the garment cloth by the conical dome and to insert the cone into the toroid upper circular opening situated outside the garment cloth opposite the conical dome; inserting the cone through the toroid upper circular opening is configured to bend the multiplicity of flaps and to trap the cone inside the button;

wherein the trapped cone which is situated beneath the multiplicity of flaps that are resting diagonally on the pole above the cone, is configured to prevent detachment and separation of the button from the retaining disk and from the garment cloth;

whereby, completing the attachment of the button by permanently attaching the button to the garment cloth; wherein the button assembly also comprises of a spacer ring which is installed around the pole beneath the garment cloth after piercing the garment cloth; the spacer ring is configured to space the button from the garment cloth in order to facilitate buttoning.

7. The button assembly of claim 6, wherein a radius of the toroid upper circular opening is configured to be larger than a radius of the upper plane of the cone by at least a thickness of the planar disk.

8. The button assembly of claim 6, wherein a radius of a circular cross section of the pole is configured to be smaller than a radius of the circular upper plane of the cone by at least a thickness of the planar disk.

9. The button assembly of claim 6, wherein a piercing cone which is configured to facilitate piercing of the garment cloth when pushed through it, is temporarily attached to a bottom of the conical dome; the piercing cone is configured to be detached and removed after piercing.

10. The button assembly of claim 6, wherein a piercing cone which is configured to facilitate piercing of the garment cloth when pushed through it, is temporarily installed in a cavity drilled at a bottom of the conical dome; the piercing cone is configured to be detached and removed after piercing.

* * * * *